US012054846B2

(12) United States Patent
Cha et al.

(10) Patent No.: US 12,054,846 B2
(45) Date of Patent: Aug. 6, 2024

(54) ELECTROPLATING APPARATUS AND ELECTROPLATING METHOD

(71) Applicant: SAMSUNG ELECTRONICS CO., LTD., Suwon-si (KR)

(72) Inventors: Taiseung Cha, Hwaseong-si (KR); Taewan Kang, Suwon-si (KR); Donghwan Park, Suwon-si (KR); Sunggon Kim, Seoul (KR); Sungkeun Lee, Osan-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/943,376

(22) Filed: Sep. 13, 2022

(65) Prior Publication Data

US 2023/0083395 A1 Mar. 16, 2023

(30) Foreign Application Priority Data

Sep. 15, 2021 (KR) ..... 10-2021-0123370
Dec. 15, 2021 (KR) ..... 10-2021-0179961

(51) Int. Cl.
*C25D 5/18* (2006.01)
*C25D 7/12* (2006.01)
(Continued)

(52) U.S. Cl.
CPC ..... *C25D 5/18* (2013.01); *C25D 7/123* (2013.01); *C25D 17/001* (2013.01);
(Continued)

(58) Field of Classification Search
CPC ..... C25D 7/12–123; C25D 17/001; H01L 21/2885; H01L 21/76873; H01L 2224/11462
See application file for complete search history.

(56) References Cited

U.S. PATENT DOCUMENTS 5,883,762 A * 3/1999 Calhoun ..... C25D 7/00
8,372,757 B2 2/2013 Mayer et al.
(Continued)

FOREIGN PATENT DOCUMENTS

CN 110777412 A * 2/2020
JP 06256999 9/1994
(Continued)

OTHER PUBLICATIONS

Ko et al., "Visualization of Ion Transport and pH Change in Ion Concentration Polarization", Journal of the Korean Society of Visualization, vol. 8, Issue 4, pp. 37-42, 2010 (with English translation).
(Continued)

*Primary Examiner* — Hosung Chung
(74) *Attorney, Agent, or Firm* — F. CHAU & ASSOCIATES, LLC

(57) ABSTRACT

An electroplating apparatus includes: an electroplating bath including an anode region, in which an anode electrode is arranged, a cathode region and a membrane; a head unit including a contact ring holding a wafer and configured so that a first cathode potential is applied to the contact ring during an electroplating process; a reverse potential electrode arranged adjacent to the membrane and configured so that a second cathode potential is applied to the reverse potential electrode during the electroplating process, and a reverse cathode potential is applied to the reverse potential electrode during a rinsing process; and a power supply unit configured to apply the first cathode potential and the second cathode potential during the electroplating process, and further configured to apply the reverse cathode potential and a reverse anode potential to the anode electrode during the rinsing process.

12 Claims, 11 Drawing Sheets

(51) Int. Cl.

| | |
|---|---|
| ***C25D 17/00*** | (2006.01) |
| ***C25D 17/08*** | (2006.01) |
| ***C25D 21/08*** | (2006.01) |
| ***C25D 21/12*** | (2006.01) |
| ***C25D 21/18*** | (2006.01) |

(52) U.S. Cl.
CPC ..... *C25D 17/002* (2013.01); *C25D 17/08* (2013.01); *C25D 21/08* (2013.01); *C25D 21/12* (2013.01); *C25D 21/18* (2013.01)

(56) References Cited

U.S. PATENT DOCUMENTS

| | | | | |
|---|---|---|---|---|
| 10,190,232 | B2 | 1/2019 | Buckalew et al. | |
| 10,633,757 | B2 | 4/2020 | Shimoyama et al. | |
| 10,930,511 | B2 | 2/2021 | Velmurugan et al. | |
| 2003/0034250 | A1* | 2/2003 | Hey | H01L 21/67028 257/E21.175 |
| 2004/0132299 | A1 | 7/2004 | Matsuda et al. | |
| 2005/0145499 | A1* | 7/2005 | Kovarsky | H01L 21/76873 205/103 |
| 2006/0283716 | A1 | 12/2006 | Hafezi et al. | |
| 2007/0062816 | A1 | 3/2007 | Chung et al. | |
| 2010/0032303 | A1* | 2/2010 | Reid | C25D 17/001 204/252 |
| 2012/0043216 | A1* | 2/2012 | Arvin | C25D 17/12 204/287 |
| 2012/0061246 | A1* | 3/2012 | Feng | H01L 21/2885 204/286.1 |
| 2014/0132299 | A1 | 5/2014 | Kadyshevitch et al. | |
| 2019/0177869 | A1* | 6/2019 | McHugh | C25D 7/123 |
| 2022/0119981 | A1* | 4/2022 | Shimomura | C25D 17/02 |

FOREIGN PATENT DOCUMENTS

| | | |
|---|---|---|
| JP | 11172496 | 6/1999 |
| JP | 2004-204308 | 7/2004 |
| JP | 2014-114496 | 6/2014 |

OTHER PUBLICATIONS

Lee, "Ion Concentration Polarization and Microfluidics Application Technologies", News & Information for Chemical Engineers, vol. 37, No. 5, Oct. 2019, 19 pages (with English translation).

* cited by examiner

ELECTROPLATING APPARATUS AND ELECTROPLATING METHOD

CROSS-REFERENCE TO RELATED APPLICATION

This application claims priority under 35 U.S.C. § 119 to Korean Patent Application No. 10-2021-0123370, filed on Sep. 15, 2021 and Korean Patent Application No. 10-2021-0179961, filed on Dec. 15, 2021 in the Korean Intellectual Property Office, the disclosures of which are incorporated by reference herein in their entireties herein.

1. TECHNICAL FIELD

The present inventive concept relates to an electroplating apparatus and an electroplating method, and more particularly, to an electroplating apparatus capable of electrodeposition to form a metal film on a wafer and an electroplating method using the electroplating apparatus.

2. DISCUSSION OF RELATED ART

A metal film, such as a copper film, may be formed on a semiconductor wafer by an electroplating apparatus. The metal ions in the electroplating solution may be precipitated on the wafer and a metal film may be formed by immersing a wafer in an electroplating bath including an electroplating solution containing metal ions and providing a current thereto. However, due to a high degree of integration and scale-down characteristics of recent semiconductor devices, a micro-sized metal film having a three-dimensional (3D) structure has been required. Furthermore, the level of difficulty of an electroplating process to form a high-quality micro-sized metal film having a 3D structure has also increased.

SUMMARY

Embodiments of the present inventive concept provide an electroplating apparatus capable of supplementing a metal ion imbalance between a cathode region and an anode region in an electroplating process, and an electroplating method using the electroplating apparatus.

According to an embodiment of the present inventive concept, an electroplating apparatus includes an electroplating bath accommodating an electroplating solution. The electroplating bath includes a membrane dividing the electroplating bath into an anode region and a cathode region. An anode electrode is arranged in the anode region and a reverse potential electrode is arranged adjacent to the membrane in the cathode region. A head unit includes a contact ring holding a wafer to be immersed in the cathode region of the electroplating bath and configured to receive a first cathode potential when an electroplating process is performed on the wafer. The reverse potential electrode is configured to receive a second cathode potential when the electroplating process is performed on the wafer, and is configured to receive a reverse cathode potential when a rinsing process is performed on the wafer. A power supply unit is configured to apply the first cathode potential to the contact ring, apply the second cathode potential to the reverse potential electrode, and apply an anode potential to the anode electrode when the electroplating process is performed on the wafer, and further configured to apply the reverse cathode potential to the reverse potential electrode and apply a reverse anode potential to the anode electrode when the rinsing process is performed on the wafer.

According to an embodiment of the present inventive concept, an electroplating method includes moving a wafer to an electroplating process unit. The wafer is mounted to be in contact with a contact ring and the wafer is immersed in an electroplating bath. The electroplating bath includes an electroplating solution and a membrane that divides the electroplating bath into an anode region and a cathode region. An anode electrode is arranged in the anode region and a reverse potential electrode is arranged adjacent to the membrane in the cathode region. An electroplating mode is performed on the wafer to form a metal film on the wafer. The electroplating mode includes applying a first cathode potential to the contact ring and applying an anode potential to the anode electrode from a power supply unit. A compensation mode is performed on the electroplating bath to compensate for an ion concentration imbalance between the cathode region and the anode region. The compensation mode includes applying a reverse anode potential to the anode electrode and applying a reverse cathode potential to the reverse potential electrode from the power supply unit after the electroplating mode is performed.

According to an embodiment of the inventive concept, an electroplating method includes moving a wafer to an electroplating process unit. The wafer is mounted to be in contact with a contact ring and the wafer is immersed in an electroplating bath. The electroplating bath includes an electroplating solution and a membrane that divides the electroplating bath into an anode region and a cathode region. An anode electrode is arranged in the anode region and a reverse potential electrode is arranged adjacent to the membrane in the cathode region. An electroplating mode is performed on the wafer to form a metal film on the wafer. The electroplating mode includes applying a first cathode potential that is a negative potential to the contact ring and applying an anode potential that is a positive potential to the anode electrode from a power supply unit. The wafer is moved from the electroplating process unit to a rinsing process unit. A compensation mode is performed on the electroplating bath to compensate for an ion concentration imbalance between the cathode region and the anode region. The compensation mode includes applying a reverse anode potential that is a negative potential to the anode electrode and applying a reverse cathode potential that is a positive potential to the reverse potential electrode from the power supply unit after the electroplating mode. In the performing of the compensation mode, a hydrogen ion contained in the electroplating solution of the cathode region passes through the membrane and moves into the electroplating solution of the anode region.

BRIEF DESCRIPTION OF THE DRAWINGS

Embodiments of the present inventive concept will be more clearly understood from the following detailed description taken in conjunction with the accompanying drawings in which.

DETAILED DESCRIPTION OF EMBODIMENTS

Hereinafter, embodiments of the present inventive concept are described in detail with reference to the accompanying drawings.

Figure 1:
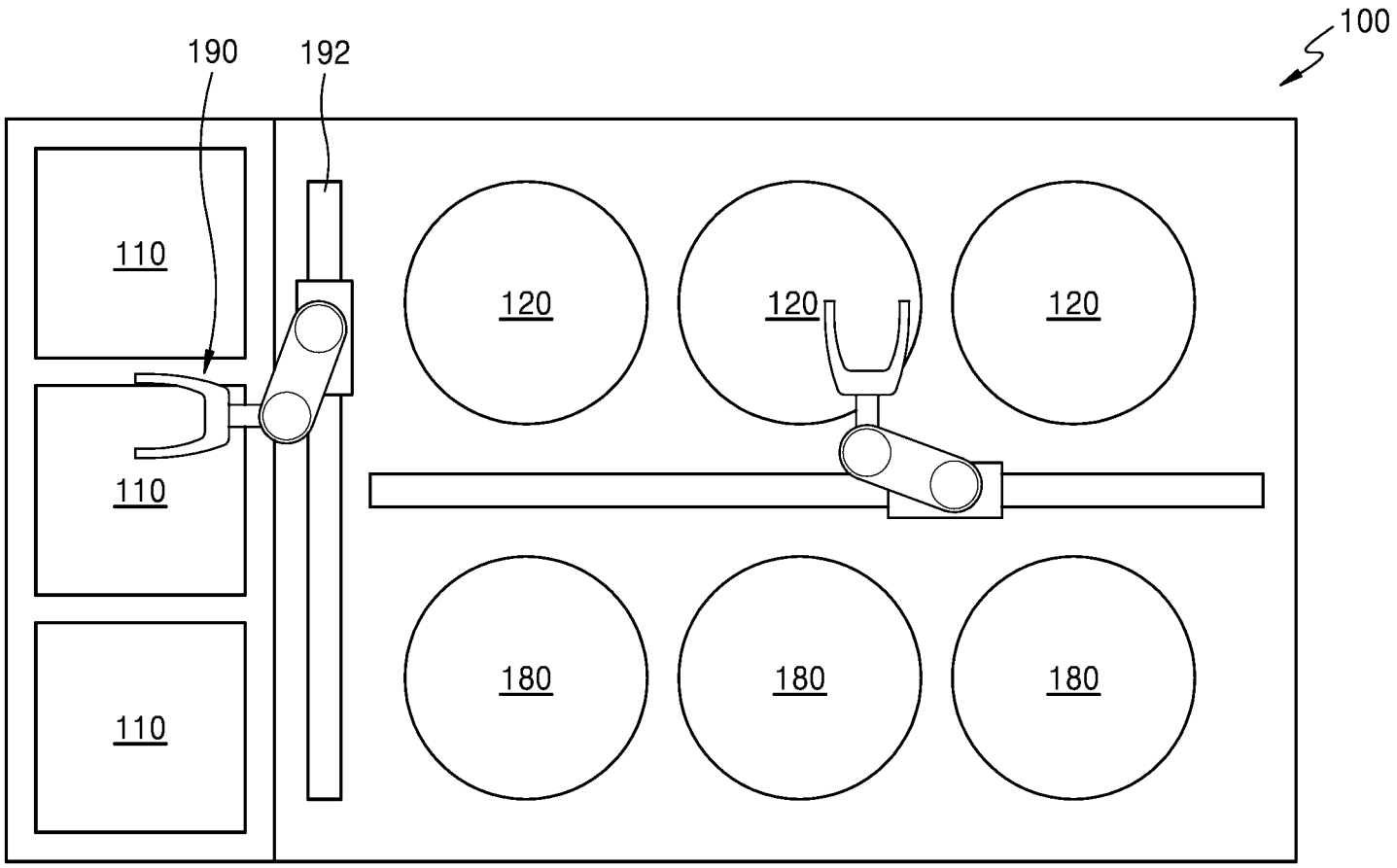
FIG. 1 is a schematic diagram of an electroplating apparatus according to an embodiment of the present inventive concept.
Figure 2:
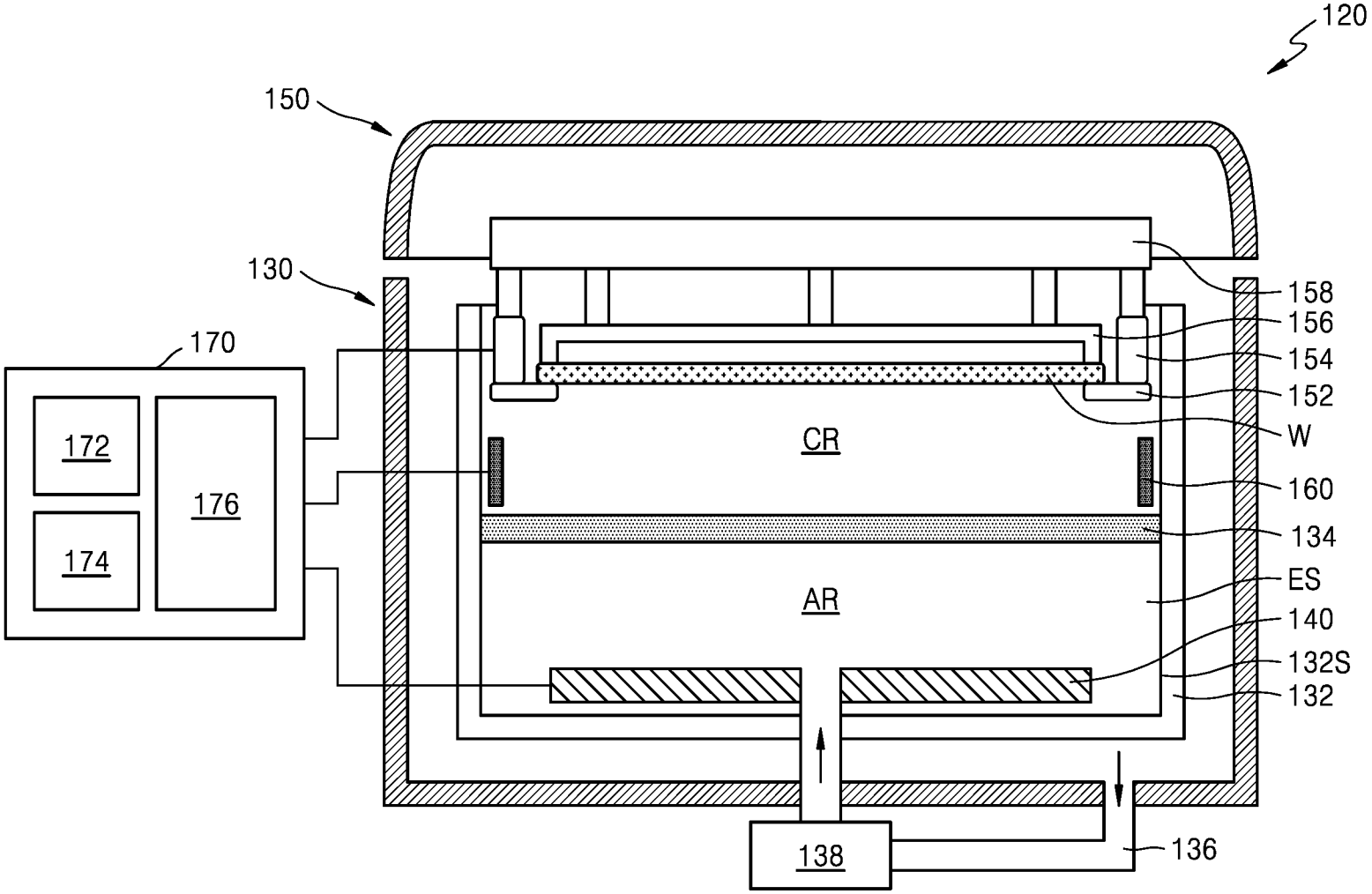
FIG. 2 is a cross-sectional view of an electroplating process unit of the electroplating apparatus of FIG. 1 according to an embodiment of the present inventive concept.
Figure 3:
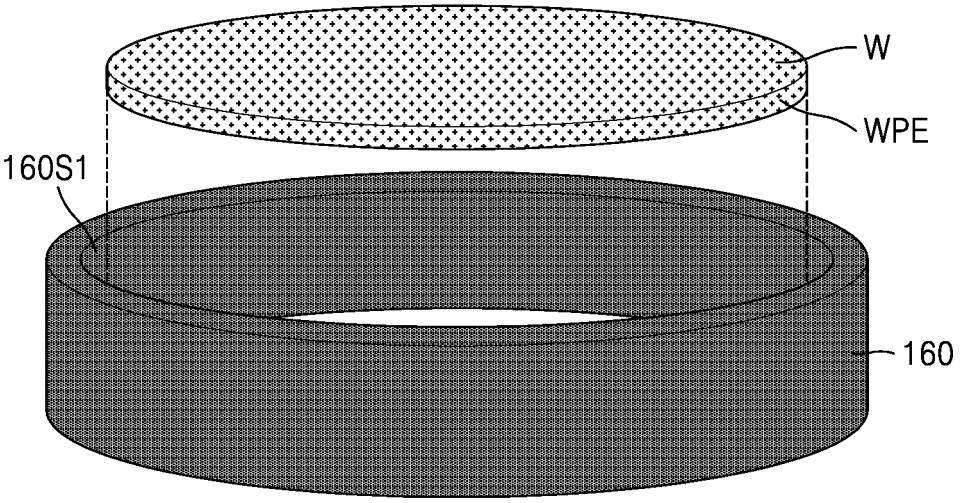
FIG. 3 is a schematic perspective view of a reverse potential electrode of the electroplating process unit of FIG. 2 according to an embodiment of the present inventive concept.

FIG. 1 is a schematic diagram of an electroplating apparatus 100 according to an embodiment. FIG. 2 is a cross-sectional view of an electroplating process unit 120 of the electroplating apparatus 100 of FIG. 1. FIG. 3 is a schematic perspective view of a reverse potential electrode 160 of the electroplating process unit 120 of FIG. 2.

With reference to FIGS. 1 to 3, the electroplating apparatus 100 may include a loading/unloading, unit 110, the electroplating process unit 120, a rinsing process unit 180, and a moving unit 190.

A cassette including a plurality of wafers may be arranged at the loading/unloading unit 110. The moving unit 190 may move an individual water from the loading/unloading unit 110 to the electroplating process unit 120, move an individual wafer from the electroplating process unit 120 to the rinsing process unit 180, and move an individual wafer from the rinsing process unit 180 to the loading/unloading unit 110. In an embodiment, the moving unit 190 may include a robot which moves along a movement track 192 to transport an individual wafer. However, embodiments of the present inventive concept are not necessarily limited thereto.

The electroplating process unit 120 may include an electroplating bath 130, an anode electrode 140, a head unit 150, the reverse potential electrode 160, and a power supply unit 170.

The electroplating process unit 120 may be a device to form a metal film through reduction precipitation of metal ions on a wafer W according to the principle of electrolysis. In an embodiment, the electroplating process unit 120 may form a plating film including a metal, such as copper (Cu), gold (Au), silver (Ag), platinum (Pt), etc., on a surface of the wafer W. The wafer W may include a silicon wafer, a germanium wafer, a ceramic wafer, etc. However, embodiments of the present inventive concept are not necessarily limited thereto.

The electroplating bath 130 may accommodate an electroplating solution ES therein. The electroplating bath 130 may include an electroplating chamber 132 having an internal space 132S for accommodating the electroplating solution ES. The electroplating solution ES may be an electrolyte solution including a metallic salt aqueous solution. For example, in an embodiment in which a copper film is electroplated on the wafer W, the electroplating solution ES may include a copper sulfate ($CuSO_4$) aqueous solution.

A membrane 134 may be arranged in the electroplating chamber 132. The membrane 134 may be an ion-selective membrane. The membrane 134 may divide the internal space 132S into a cathode region CR and an anode region AR. The membrane 134 may prevent contamination of the wafer W due to movement of particles, which are formed at the anode region AR, into the cathode region CR and may allow transmission of ions between the anode region AR and the cathode region CR.

In an embodiment, the membrane 134 may include at least one compound selected from tetrafturoethylene hexafluoropropilene (HT), perfluoroalkyl alkylvinyl-ether (PFA), ethylene-tetrafluoroethylene (ETFE), polyvinylidene fluoride (PVDF), polytetrafluoroethylene (PTFE), polyethylene (PE), polypropylene (PP), polyether ether ketone (PEEK), polyarylsulfone (PSU), polyethersulphone (PES), polyimide (Pt), and polybenzimidazole (PBI). In an embodiment, the membrane 134 may include Nation®.

In an embodiment, a supply portion through which the electroplating solution ES is supplied may be formed at a lower portion of the electroplating chamber 132, and a discharge portion through which overflowed electroplating solution is discharged may be formed at an upper portion of a lateral wall of the electroplating chamber 132. An overflow storage to retrieve the overflowed electroplating solution ES from the electroplating chamber 132 may be formed between an outer side of the electroplating chamber 132 and an inner side of the electroplating bath 130. In an embodiment, the overflow storage of the electroplating bath 130 may be interconnected with the internal space 132S of the electroplating chamber 132 through a circulation line 136. A pump may be provided at the circulation line 136 to supply the electroplating solution ES to the electroplating chamber 132.

The electroplating solution ES provided from the supply portion of the electroplating chamber 132 to the internal space 132S may move upwards to the wafer W, and the overflowed electroplating solution ES may be filtered through the discharge portion arranged at the upper portion of the lateral wall of the electroplating chamber 132 and recirculated by the pump. A heating member 138 may be arranged at the circulation line 136 and maintain a temperature of the electroplating solution ES at a certain level.

In an embodiment, a pH meter may be further provided at the electroplating chamber 132, and the pH meter may be configured to monitor continuously or periodically a pH of the electroplating solution ES contained in the electroplating chamber 132.

The anode electrode 140 may be arranged in the electroplating chamber 132. For example, the anode electrode 140 may be arranged in the anode region AR and may be adjacent to a bottom portion of the electroplating chamber 132. In an embodiment, the anode electrode 140 may be a plate including a metal to be electro-deposited through the electroplating process. The anode electrode 140 may include, for example, a copper (Cu) plate. However, embodiments of the present inventive concept are not necessarily limited thereto.

The head unit 150 may be arranged on the lateral wall of the electroplating chamber 132 and may hold the wafer W so that the wafer W is immersed in the electroplating solution ES. The head unit 150 may move upwards and downwards so that the wafer W is immersed in the electroplating solution ES when the electroplating process is performed. For example, in an embodiment the head unit 150 may include a holder portion 152, a contact ring 154, a support portion 156, and a rotor 158. The holder portion 152, the contact ring 154, and the support portion 156 may hold the wafer W, and the wafer W may be rotated by the rotor 158 connected to the support portion 156 and the contact ring 154 along with the holder portion 152, the contact ring 154, and the support portion 156.

In an embodiment, the holder portion 152 may have a ring shape in direct contact with an edge portion of the wafer W, and may be arranged to hold the edge portion of the wafer W. The contact ring 154 having a ring shape may be connected to the holder portion 152 and arranged at an outer perimeter of the wafer W. When the electroplating process is performed, a first cathode potential may be applied to the contact ring 154, and according to this, by applying a potential to the wafer W electrically connected to the contact ring 154, a seed layer on the wafer W may function as a cathode electrode. In an embodiment, the holder portion 152 and the contact ring 154 may be formed in an integrated manner. However, embodiments of the present inventive concept are not necessarily limited thereto.

In an embodiment, the support portion 156 may support a rear surface of the wafer W, and may move upwards and downwards so that an edge of a front surface of the wafer W is in direct contact with the holder portion 152. In an embodiment, a pressure member for pressing and clamping the wafer W may be further provided on the support portion 156, and for example, the pressure member may be arranged on the support portion 156 to move upwards and downwards for pressing the support portion 156 so that the support portion 156 is in close contact with the water W and the water W is in direct contact with the holder portion 152.

The reverse potential electrode 160 may be arranged in the internal space 132S of the electroplating chamber 132, for example, in the cathode region CR. In an embodiment, the reverse potential electrode 160 may be arranged adjacent to the membrane 134 on the lateral wall of the electroplating chamber 132. However, embodiments of the present inventive concept are not necessarily limited thereto.

In an embodiment, the reverse potential electrode 160 may be a ring-shaped one-piece conductive plate spaced apart from an inner wall of the electroplating chamber 132 at a certain distance. For example, as illustrated in FIG. 3, the reverse potential electrode 160 may be formed to surround the wafer W so as to not interrupt or interfere with the movement of metal ions towards the water W from the anode electrode 140 and may have a diameter greater than an outer perimeter area WPE of the wafer Win a plan view. As illustrated in FIG. 3, a space defined by an inner lateral wall 160S1 of the reverse potential electrode 160 may be arranged to vertically overlap the wafer W. However, embodiments of the present inventive concept are not limited thereto.

For example, according to an embodiment, unlike the illustration of FIG. 3, the reverse potential electrode 160 may include at least two conductive plates arranged to be spaced apart from the inner wall of the electroplating chamber 132 at a certain distance and spaced apart from each other.

The reverse potential electrode 160 may be configured so that when the electroplating process is performed on the wafer W, a second cathode potential is applied to the reverse potential electrode 160, and when the rinsing process is performed after the electroplating process is completed, a reverse cathode potential is applied to the reverse potential electrode 160. As the reverse cathode potential is applied to the reverse potential electrode 160, and the reverse anode potential is applied to the anode electrode 140, during the compensation mode after the electroplating mode, a field in opposite direction may be applied between the cathode region CR and the anode region AR, thereby compensating for the imbalance of metal ions and hydrogen ions.

The power supply unit 170 may be configured to provide an electric signal to the contact ring 154, the anode electrode 140, and the reverse potential electrode 160. For example, in an embodiment the power supply unit 170 may include a first power supply 172, a second power supply 174, and a power controller 176. For example, the first power supply 172 may be configured to apply an electric signal to the contact ring 154 and the anode electrode 140, and the second power supply 174 may be configured to apply an electric signal to the reverse potential electrode 160. The power controller 176 may perform a switching function to control a voltage signal applied to the contact ring 154, the anode electrode 140, and the reverse potential electrode 160 in the electroplating mode in which the electroplating process is performed on the wafer W and the subsequent compensation mode.

In an embodiment, as the reverse cathode potential is applied to the reverse potential electrode 160, and the reverse anode potential is applied to the anode electrode 140 during the compensation mode in which the rinsing process is performed on the wafer W after the electroplating process is completed, the hydrogen ions (H) may move through the membrane 134 in the electroplating solution ES, and accordingly, the ion imbalance between the cathode region CR and the anode region AR may be compensated for. A metal film having excellent film characteristics may be formed on the wafer W through a continuous electroplating process using the electroplating apparatus 100.

Figure 4:
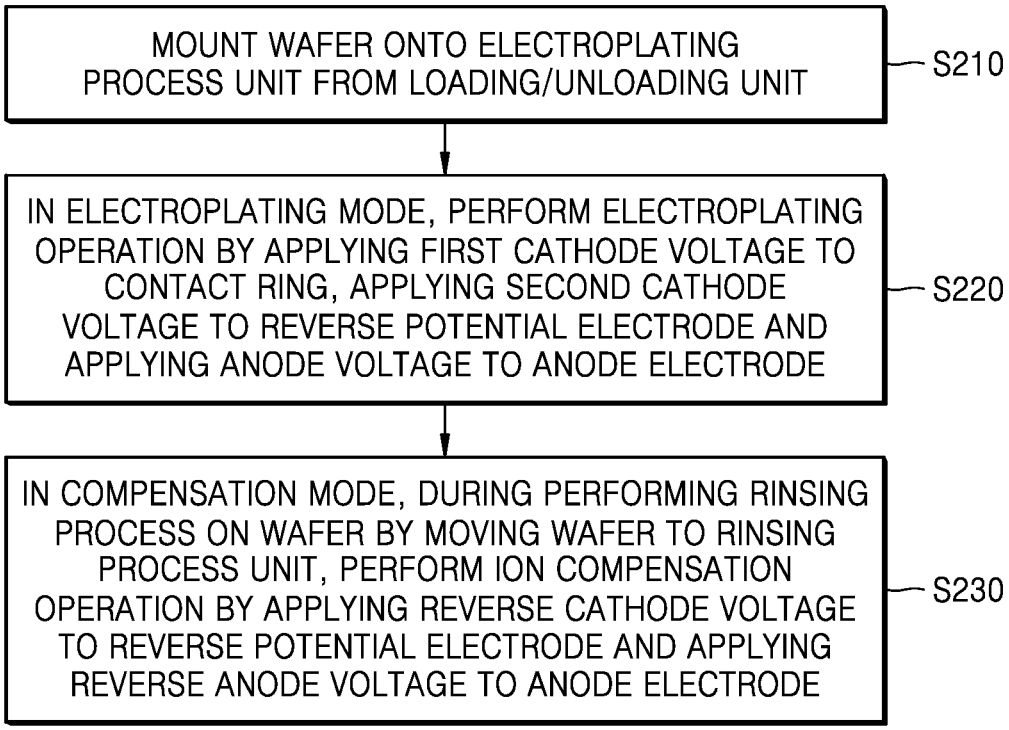
FIG. 4 is a flowchart of an electroplating method according to an embodiment of the present inventive concept.
Figure 5:
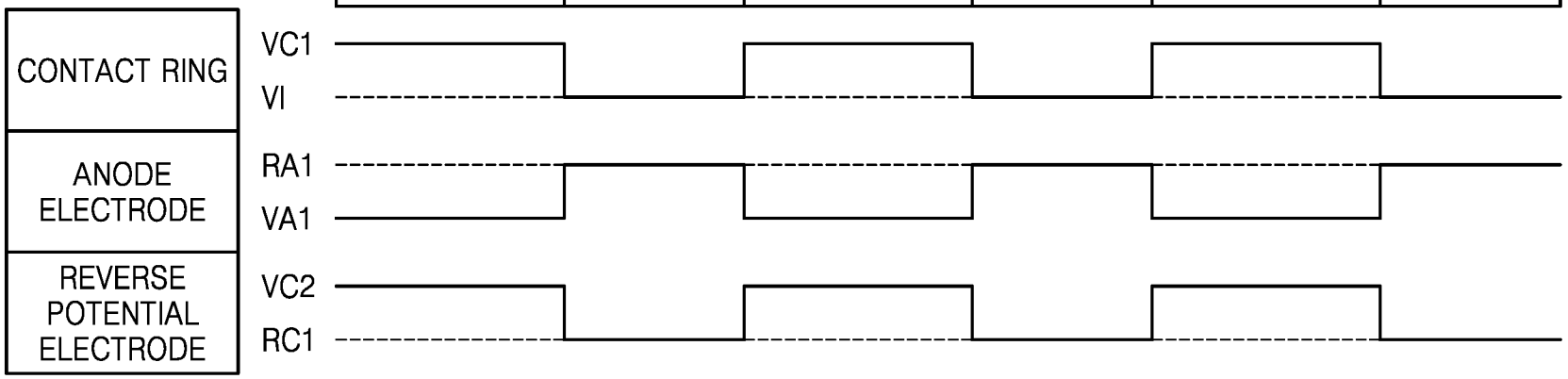
FIG. 5 is a timing chart illustrating a potential applied to an electroplating process unit in an electroplating mode and a compensation mode of FIG. 4 according to an embodiment of the present inventive concept.
Figure 6:
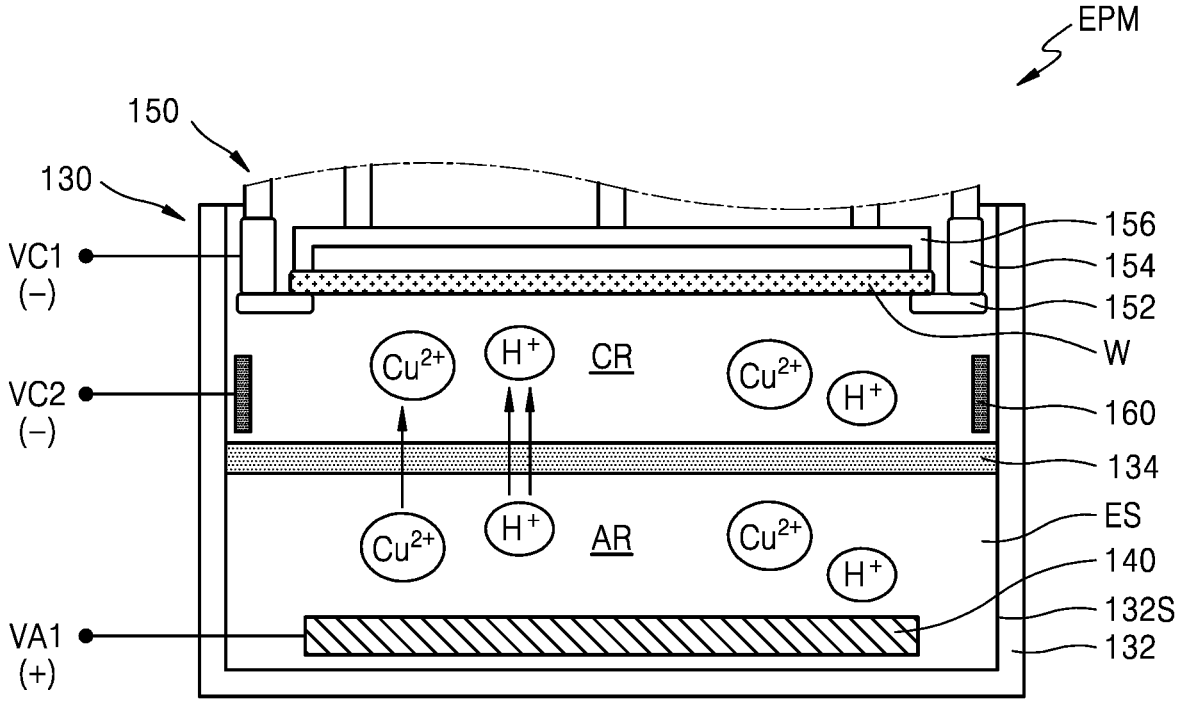
FIG. 6 is a schematic cross-sectional view of a voltage applied to an electroplating process unit in the electroplating mode of FIG. 4 according to an embodiment of the present inventive concept.
Figure 7:
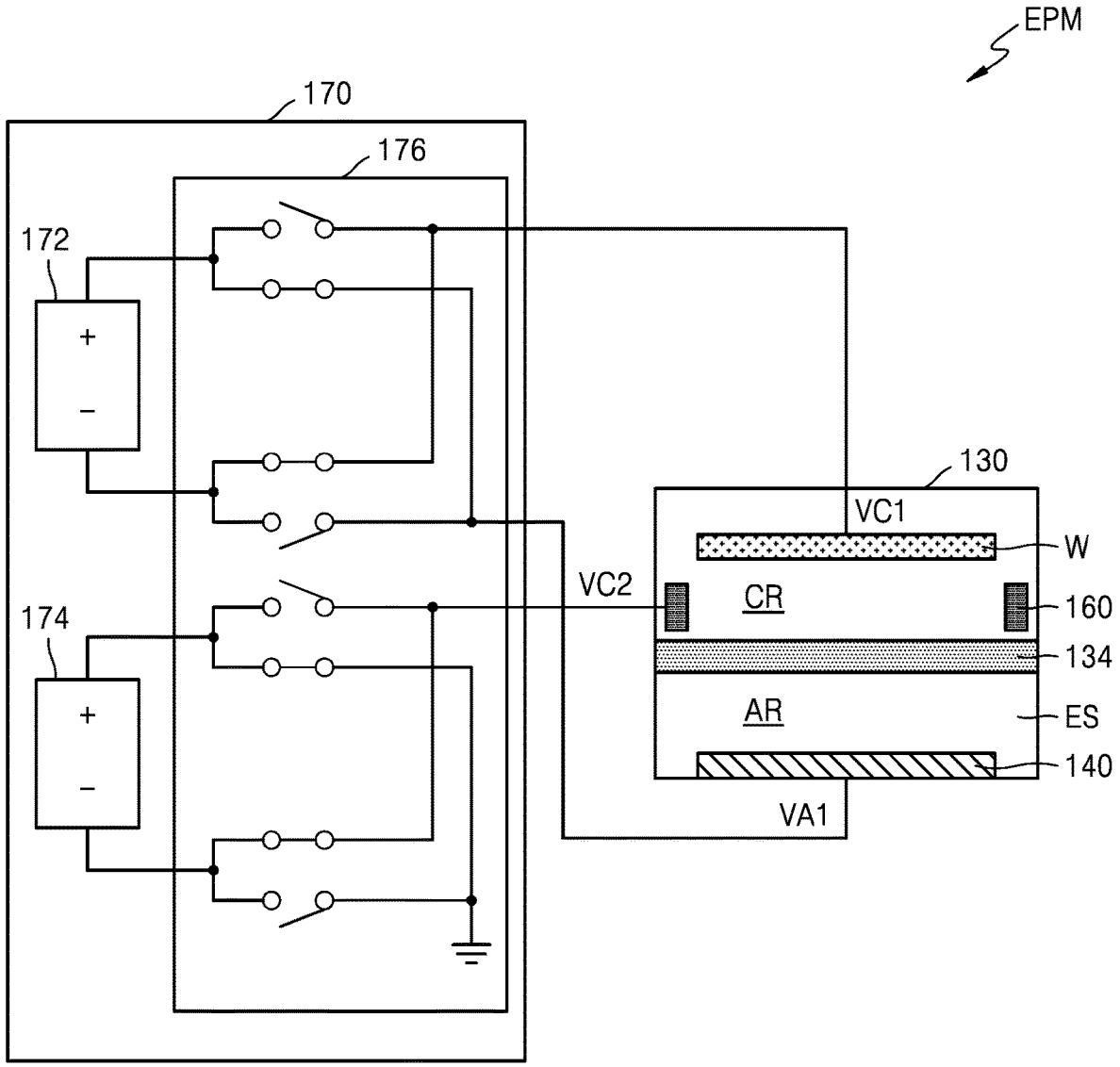
FIG. 7 is a schematic diagram of circuit configuration of a power supply unit in the electroplating mode of FIG. 4 according to an embodiment of the present inventive concept.
Figure 8:
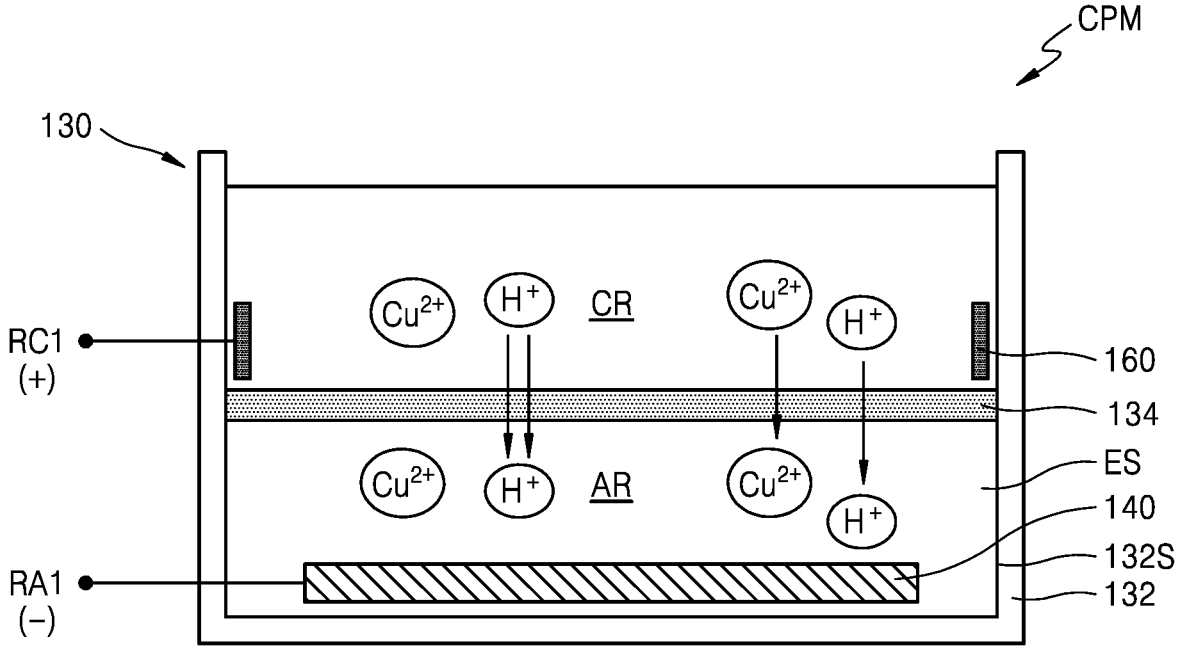
FIG. 8 is a schematic cross-sectional view of a voltage applied to an electroplating process unit in the compensation mode of FIG. 4 according to an embodiment of the present inventive concept.
Figure 9:
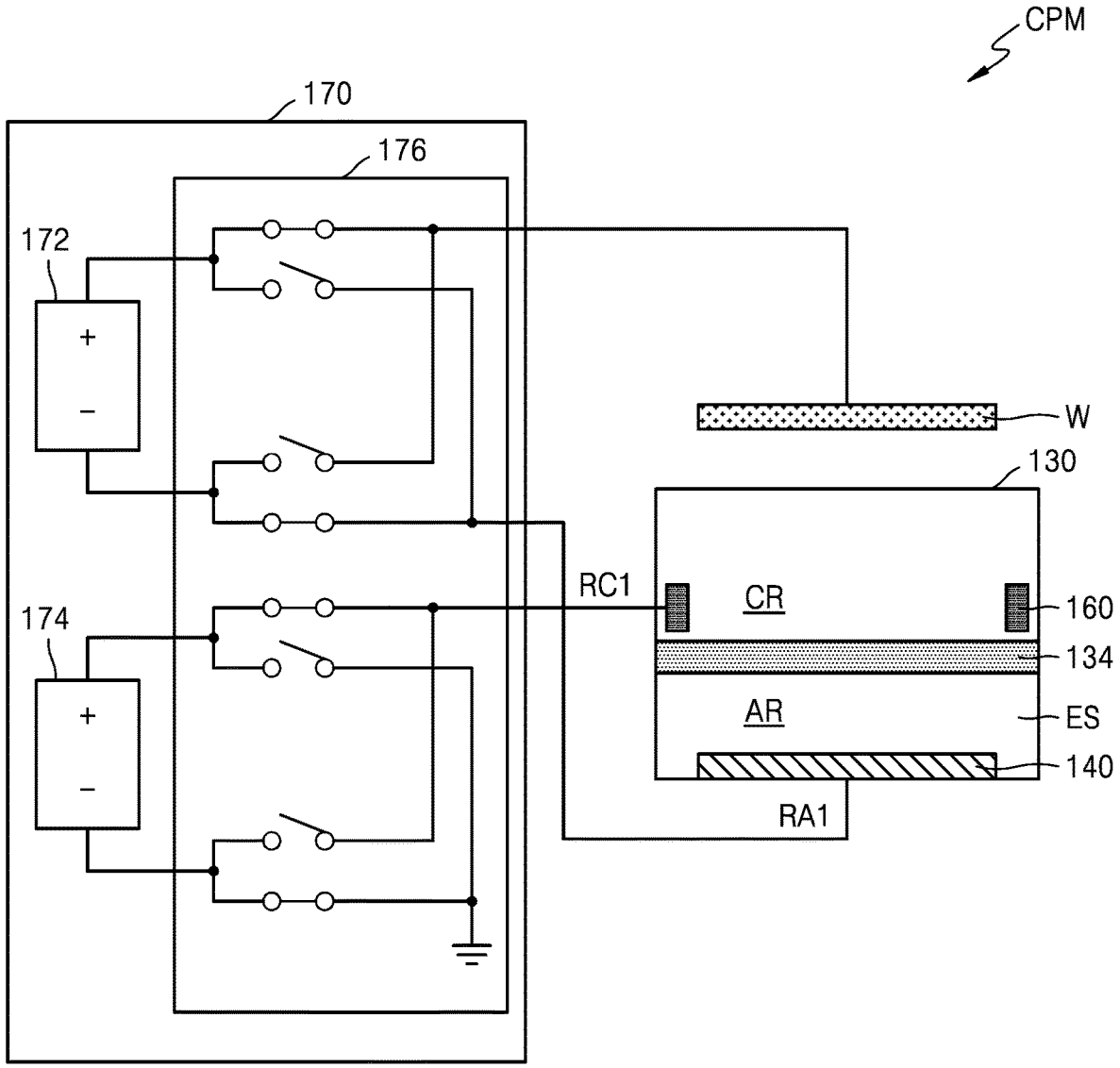
FIG. 9 is a schematic diagram of circuit configuration of a power supply unit in the compensation mode of FIG. 4 according to an embodiment of the present inventive concept.

FIG. 4 is a flowchart of an electroplating method according to an embodiment. FIG. 5 is a timing chart illustrating a potential applied to an electroplating process unit in an electroplating mode (EPM) and a compensation mode (CPM) of FIG. 4. FIG. 6 is a schematic cross-sectional view of a voltage applied to an electroplating process unit in the EPM of FIG. 4. FIG. 7 is a schematic diagram of circuit configuration of a power supply unit in the EPM of FIG. 4. FIG. 8 is a schematic cross-sectional view of a voltage applied to an electroplating process unit in the CPM of FIG. 4. FIG. 9 is a schematic diagram of circuit configuration of a power supply unit in the CPM of FIG. 4.

With reference to FIGS. 4 to 7, the wafer W may be mounted onto the electroplating process unit 120 from the loading/unloading unit 110 in block 5210.

In an embodiment, the membrane 134 may be arranged in the electroplating process unit 120, and the electroplating solution ES may be provided before the wafer W is mounted onto the electroplating process unit 120 so that the wafer W is mounted in the electroplating process unit 120 in a state where the cathode region CR and the anode region AR are physically separated from each other. In an embodiment, the electroplating solution ES may be a mixed solution of copper sulfate ($CuSO_4$) and sulfuric acid ($H_2SO_4$). However, embodiments of the present inventive concept are not necessarily limited thereto.

In an embodiment, an additive including at least one of a suppressing agent, an accelerating agent, and a leveling agent may be further provided to the electroplating solution ES in the cathode region CR, and the additive may not be provided to the electroplating solution ES in the anode region AR. For example, the membrane 134 may be an ion-selective membrane which transmits only the electroplating solution ES and ions originally included in the electroplating solution ES (e.g., copper ions and hydrogen ions) but not particles which may be generated in the electroplating solution ES or the additive (e.g., at least one of a suppressing agent, an accelerating agent, and a leveling agent).

In an embodiment, the wafer W may include a seed layer formed on the front surface of the wafer W. For example, in the operation of mounting the wafer W, the seed layer of the water W may be electrically connected to the power supply unit 170 by the holder portion 152 (see FIG. 2) and the contact ring 154 (see FIG. 2), and the wafer W may be placed so that the seed layer of the wafer W is immersed in the electroplating solution ES.

In the subsequent EPM, the electroplating operation may be performed by applying a first cathode potential VC1 to the contact ring 154, applying a second cathode potential VC2 to the reverse potential electrode 160, and applying an anode potential VA1 to the anode electrode 140 in block 5220.

In the EPM, the first cathode potential VC1, which is a negative potential, may be applied to the contact ring 154, the second cathode potential VC2, which is a negative potential, may be applied to the reverse potential electrode 160, and the anode potential VA1, which is a positive potential, may be applied to the anode electrode 140.

In an embodiment, the power supply unit 170 may include the first power supply 172, the second power supply 174, and the power controller 176. The power controller 176 may be configured so that the first cathode potential VC1, which is a negative potential, is applied to the contact ring 154 from the first power supply 172, the anode potential VA1, which is a positive potential, is applied to the anode electrode 140 from the first power supply 172, and the second cathode potential VC2, which is a negative potential, is applied to the reverse potential electrode 160 from the second power supply 174. For example, in an embodiment the second cathode potential VC2 may be identical to the first cathode potential VC1. However, embodiments of the present inventive concept are not necessarily limited thereto.

In the EPM, for example, when the anode electrode 140 includes a copper plate, copper ions ($Cu^{2+}$) may be dissolved into the electroplating solution ES from the anode electrode 140. The copper ions ($Cu^{2+}$) may pass through the membrane 134 from the anode region AR to be mixed into the cathode region CR, and may move towards the wafer W so that the copper ions ($Cu^{2+}$) are precipitated on the wafer W as a copper film.

In an embodiment, the EPM may be performed for a first time period t1 ranging from about 30 seconds to about 2 minutes. However, embodiments of the present inventive concept are not necessarily limited thereto. In an embodiment, the first time period t1 of the EPM may vary depending on a concentration of copper ions in the electroplating solution ES, a size of the first cathode potential VC1, a thickness of a metal film to be formed on the wafer W, etc.

With reference to FIGS. 4, 5, 8, and 9, in the CPM, during the rinsing process performed on the wafer W by moving the wafer W to the rinsing process unit 180 (see FIG. 1), a reverse cathode potential RC1 may be applied to the reverse potential electrode 160, and a reverse anode potential RA1 may be applied to the anode electrode 140 to perform an ion compensation operation in block 5230.

In an embodiments, the CPM may be performed subsequently to the EPM, and for example, may be performed for a second time period t2 after the EPM is completed. In an embodiment, the CPM may be performed for the second time period t2 ranging from about 10 seconds to about 30 seconds. However, embodiments of the present inventive concept are not necessarily limited thereto.

In an embodiment, the EPM may be performed as a part of the continuous electroplating process for increasing electroplating throughput of a metal film on the wafer W. For example, the electroplating process in the EPM and the rinsing process in the rinsing mode subsequent thereto may be sequentially performed on the wafer W, and after the electroplating process is performed on the wafer W in the electroplating process unit 120, the wafer W may be moved to the rinsing process unit 180 for the rinsing process.

For example, in an embodiment the CPM may be performed simultaneously with the rinsing mode in which the rinsing process is performed on the wafer W. For example, after the EPM is completed, when the wafer W is moved to the rinsing process unit 180 and the rinsing process is performed on the wafer W, for example, the ion compensation operation may be performed in the electroplating process unit 120 in the CPM for the second time period t2.

FIG. 7 illustrates that the wafer W is separated from the electroplating process unit 120, and in such an embodiment, the wafer W may be arranged in the rinsing process unit 180 in a state where the wafer W is mounted onto the head unit 150 or separated from the head unit 150. However, embodiments of the present inventive concept are not necessarily limited thereto, and the wafer W may be separated from the head unit 150 and arranged in the rinsing process unit 180, and a part of the head unit 150, for example, the holder portion 152 and the contact ring 154, may be immersed and arranged in the electroplating solution ES.

In the CPM, the reverse cathode potential RC1, which is a positive potential, may be applied to the reverse potential electrode 160, and the reverse anode potential RA1, which is a negative potential, may be applied to the anode electrode 140. In an embodiment, the power controller 176 may be configured so that the reverse cathode potential RC1, which is a positive potential, is applied to the reverse potential electrode 160 from the second power supply 174, the reverse anode potential RA1, which is a negative potential, is applied to the anode electrode 140 from the first power supply 172, and a reference potential VI, which is a positive potential, is applied to the contact ring 154.

In the CPM, as the reverse cathode potential RC1 is applied to the reverse potential electrode 160, the hydrogen ions (Fr) contained in the cathode region CR in a concentration relatively higher than that in the anode region AR may pass through the membrane 134 and move to the anode region AR.

According to the aforementioned operations, a metal film may be formed on the wafer W.

In an embodiment, in the EPM and the CPM, the pH of the electroplating solution ES of the cathode region CR or the pH of the electroplating solution ES of the anode region AR may be consecutively measured by using the pH meter. When the pH of the electroplating solution ES of the cathode region CR is out of a target pH range, for example, when the pH of the electroplating solution ES of the cathode region CR has a value greater than the target pH range or the pH of the electroplating solution ES of the anode region AR has a value less than the target pH range, the CPM may be additionally performed.

In an embodiment, when the pH of the electroplating solution ES of the cathode region CR is out of the target pH range, for example, when the pH of the electroplating solution ES of the cathode region CR has a value greater than the target pH range, or the pH of the electroplating solution ES of the anode region AR has a value less than the target pH range, the second time period t2 for the CPM may be increased.

In an embodiment, after repetitively performing the EPM and the CPM n times, an additional compensation mode may be further performed. For example, in an embodiment after repetitively performing the EPM and the CPM about 10, about 20, about 50, about 100, about 200, or about 300 times, an additional compensation mode may be performed. In an embodiment, the additional compensation mode may be performed for the second time period t2 ranging from, for example, about 20 seconds to about one minute.

In general, to continuously perform the electroplating process on the wafer \V, the EPM may be performed in the electroplating process unit 120 for the first time period t1, and then the rinsing mode may be performed in the rinsing process unit 180 for the second time period t2, which is relatively short. Afterwards, another wafer W may be loaded into the electroplating process unit 120 and the EPM and the rinsing mode may be sequentially performed on the wafer W. As such, as the electroplating process is consecutively performed, a non-uniform concentration distribution of the copper ion ($Cu^{2+}$) and the hydrogen ions ($H^+$) may occur in the electroplating solution ES, as described below with reference to FIGS. 10A and 10B.

For example, as the hydrogen ions ($H^+$) may pass through the membrane 134 and disperse relatively faster than the copper ion ($Cu^{2+}$), a relatively low concentration hydrogen ions ($H^+$) may be contained in the anode region AR, and a relatively high concentration hydrogen ions ($H^+$) may be contained in the cathode region CR. For example, as the electroplating process is performed consecutively, the pH of the electroplating solution ES of the anode region AR may be increased gradually, and the pH of the electroplating solution ES of the cathode region CR may be decreased gradually. As such, when polarization due to the ion imbalance between the cathode region CR and the anode region AR occurs, the copper ions ($Cu^{2+}$) may not be provided sufficiently onto the wafer W in the cathode region CR, and an undesired void may be formed at the metal film formed on the wafer W by the electroplating process. Furthermore, discoloration caused by metal particle precipitation due to the ion imbalance may occur at the membrane, or process expenses may increase because an additional electroplating solution is required to supplement the copper ions.

However, according to an embodiment of the present inventive concept, as the reverse cathode potential RC1 is applied to the reverse potential electrode 160 and the reverse anode potential RA1 is applied to the anode electrode 140 in the CPM, during the CPM in which the rinsing process is performed on the wafer W after the electroplating process is completed, in the electroplating solution ES, the hydrogen ions ($H^+$) may move through the membrane 134, and accordingly, the ion imbalance between the cathode region CR and the anode region AR may be compensated therefor. Through the consecutive electroplating process, a metal film having excellent film characteristics may be formed on the wafer W. For example, by using the consecutive electroplating method, a micro-sized metal film having a 3D structure may be bottom-up-filled on the wafer W without a void. Additionally, the discoloration of the membrane and the supply of the electroplating solution may be reduced which leads to reduced process expenses.

Hereinafter, an ion imbalance, which may occur in the electroplating method according to the comparative example, is described in detail with reference to FIGS. 10A and 10B.

Figure 10A:
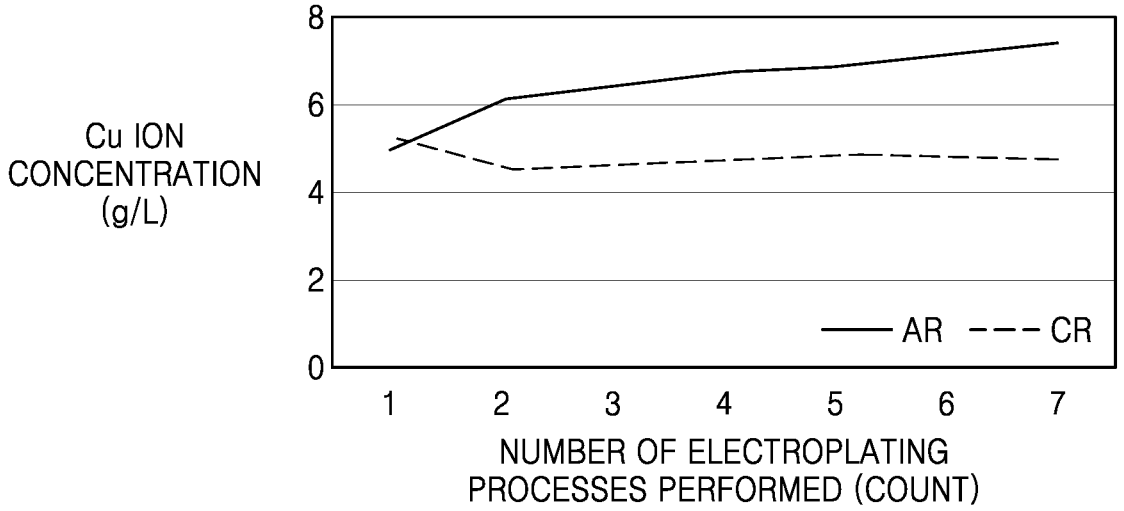
FIG. 10A is a graph showing a Cu ion concentration with respect to the number of electroplating processes in an electroplating method according to a comparative example.
Figure 10B:
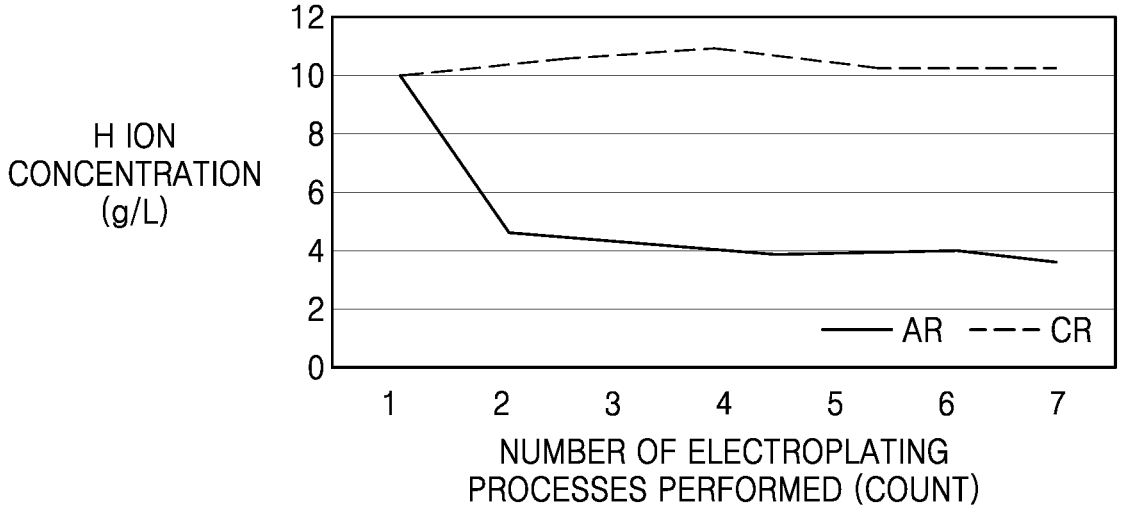
FIG. 10B is a graph showing an H ion concentration with respect to the number of electroplating processes in an electroplating method according to a comparative example.

FIG. 10A is a graph showing a Cu ion concentration with respect to the number of electroplating processes in an electroplating method according to a comparative example, and FIG. 10B is a graph showing an H ion concentration with respect to the number of electroplating processes in an electroplating method according to a comparative example.

Specifically, the electroplating mode is consecutively performed 7 times by the electroplating method according to the comparative example, and the copper ion concentration and the hydrogen ion concentration in the cathode region CR and the anode region AR are continuously monitored.

With reference to FIG. 10A, when consecutively performing the electroplating process, the copper ion concentration decreases in the cathode region CR, whereas the copper ion concentration increases in the anode region AR. The reduction of the copper ion concentration in the cathode region CR and the increase in the copper ion concentration in the anode region AR may be because even though the copper ion is continuously dissolved from the anode electrode, the copper ion fails to pass through the membrane and to be sufficiently provided to the cathode region CR.

With reference to FIG. 10B, when consecutively performing the electroplating process, the hydrogen ion concentration increases in the cathode region CR, whereas the hydrogen ion concentration decreases significantly in the anode region AR, and remains at a low level. The increase in the hydrogen ion concentration in the cathode region CR and the significant decrease in the hydrogen ion concentration in the anode region AR may be because the hydrogen ion moves relatively fast from the anode region AR to the cathode region CR, causing an ion imbalance between the anode region AR and the cathode region CR.

While the present inventive concept have been particularly shown and described with reference to embodiments thereof, it will be understood that various changes in form and details may be made therein without departing from the spirit and scope of the present inventive concept.

What is claimed is:

1. An electroplating method comprising:

moving a wafer to an electroplating process unit;

mounting the water to be in contact with a contact ring and immersing the wafer in an electroplating bath, the electroplating bath includes an electroplating solution and a membrane that divides the electroplating bath into an anode region and a cathode region, wherein an anode electrode is arranged in the anode region and a reverse potential electrode is arranged adjacent to the membrane in the cathode region;

performing an electroplating mode on the wafer to form a metal film on the wafer, the electroplating mode includes applying a first cathode potential that is a negative potential to the contact ring and applying an anode potential that is a positive potential to the anode electrode from a power supply unit; and performing a compensation mode on the electroplating bath to compensate for an ion concentration imbalance between the cathode region and the anode region, the compensation mode includes applying a reverse anode potential that is a negative potential to the anode electrode, applying a reverse cathode potential that is a positive potential to the reverse potential electrode from the power supply unit and applying a reference potential that is a positive potential to the contact ring after the electroplating mode is performed, wherein the compensation mode is performed solely after the wafer is removed from the electroplating bath.

2. The electroplating method of claim 1, further comprising moving the wafer from the electroplating process unit to a rinsing process unit after performing the electroplating mode and prior to performing the compensation mode, wherein the compensation mode includes performing a rinsing process on the wafer.

3. The electroplating method of claim 1, wherein the performing of the electroplating mode lasts for a first time period, and the performing of the compensation mode lasts for a second time period, that is less than the first time period.

4. The electroplating method of claim 3, wherein the first time period is in a range of thirty seconds to two minutes, and the second time period is in a range of ten seconds to thirty seconds.

5. The electroplating method of claim 1, wherein the power supply unit includes a first power supply, a second power supply, and a power supply controller, wherein, in the performing of the electroplating mode, the first power supply applies the first cathode potential to the contact ring and the anode potential to the anode electrode, and the second power supply applies a second cathode potential to the reverse potential electrode.

6. The electroplating method of claim 5, wherein the first cathode potential and the second cathode potential are equal to each other.

7. The electroplating method of claim 5, wherein, in the performing of the compensation mode, the first power supply applies the reverse anode potential to the anode electrode, and the second power supply applies the reverse cathode potential to the reverse potential electrode.

8. The electroplating method of claim 1, wherein, in the performing of the compensation mode, a hydrogen ion contained in the electroplating solution of the cathode region passes through the membrane and moves into the electroplating solution of the anode region.

9. An electroplating method comprising:

moving a wafer to an electroplating process unit;

mounting the wafer to be in contact with a contact ring and immersing the wafer in an electroplating bath, the electroplating bath includes an electroplating solution and a membrane that divides the electroplating bath into an anode region and a cathode region, wherein an anode electrode is arranged in the anode region and a reverse potential electrode is arranged adjacent to the membrane in the cathode region;

performing an electroplating mode on the wafer to form a metal film on the wafer, the electroplating mode includes applying a first cathode potential that is a negative potential to the contact ring and applying an anode potential that is a positive potential to the anode electrode from a power supply unit;

moving the wafer from the electroplating process unit to a rinsing process unit; and performing a compensation mode on the electroplating bath to compensate for an ion concentration imbalance between the cathode region and the anode region, the compensation mode includes applying a reverse anode potential that is a negative potential to the anode electrode, applying a reverse cathode potential that is a positive potential to the reverse potential electrode and applying a reference potential that is a positive potential to the contact ring from the power supply unit after the electroplating mode, wherein the compensation mode is performed solely after the wafer is removed from the electroplating bath, wherein, in the performing of the compensation mode, a hydrogen ion contained in the electroplating solution of the cathode region passes through the membrane and moves into the electroplating solution of the anode region.

10. The electroplating method of claim 9, wherein, a rinsing process is performed on the wafer during the performing of the compensation mode.

11. The electroplating method of claim 9, wherein the performing of the electroplating mode lasts for a first time period, and the performing of the compensation mode lasts for a second time period, that is less than the first time period, wherein the first time period is in a range of thirty seconds to two minutes, and the second time period is in a range of ten seconds to thirty seconds.

12. The electroplating method of claim 9, wherein the power supply unit includes a first power supply, a second power supply, and a power supply controller, wherein, in the performing of the electroplating mode, the first power supply applies the first cathode potential to the contact ring and the anode potential to the anode electrode, and the second power supply applies a second cathode potential to the reverse potential electrode, and wherein, in the performing of the compensation mode, the first power supply applies the reverse anode potential to the anode electrode, and the second power supply applies the reverse cathode potential to the reverse potential electrode, wherein the first cathode potential and the second cathode potential are equal to each other.

* * * * *